US005259796A

United States Patent [19]

Yamada et al.

[11] Patent Number: 5,259,796

[45] Date of Patent: Nov. 9, 1993

[54] ELECTRICAL SOCKET CONTACT

[75] Inventors: Satoshi Yamada; Keishi Jinno; Tamio Suzuki, all of Shizuoka, Japan

[73] Assignee: Yazaki Corporation, Japan

[21] Appl. No.: 5,149

[22] Filed: Jan. 15, 1993

[30] Foreign Application Priority Data

Jan. 27, 1992 [JP] Japan ..... 4-2366[U]

[51] Int. Cl.[5] ..... H01R 13/187

[52] U.S. Cl. ..... 439/843; 439/851

[58] Field of Search ..... 439/842, 843, 845-850, 439/861, 851-857, 668, 669

[56] References Cited

U.S. PATENT DOCUMENTS

| | | | |
|---|---|---|---|
| 3,425,030 | 1/1969 | Hadden | 439/851 |
| 4,148,547 | 4/1979 | Otsuki et al. | 439/843 |
| 4,950,183 | 8/1990 | Watanabe et al. | 439/843 |
| 4,985,004 | 1/1991 | Zinn | 439/851 |
| 5,147,230 | 9/1992 | Plyler et al. | 439/851 |
| 5,158,485 | 10/1992 | Saito et al. | 439/851 |

FOREIGN PATENT DOCUMENTS 2-52274 4/1990 Japan .

*Primary Examiner*—David L. Pirlot

*Attorney, Agent, or Firm*—Venable, Baetjer, Howard & Civiletti

[57] ABSTRACT

An electrical socket contact forms an electrical contact portion in a compact size to which a mating contact is inserted and connected. A concave portion is formed opposite to a resilient tongue in the transverse direction of a side end of the short rectangularly tubular electrical contact portion provided the resilient tongue for electrical contact within the electrical contact portion. A folded portion extending from a side free end of the electrical contact portion is also provided which engages the concave portion.

5 Claims, 2 Drawing Sheets

ELECTRICAL SOCKET CONTACT

BACKGROUND OF THE INVENTION

1. Field of the Invention

The present invention relates to an electrical connector, and more particularly, to an electrical socket contact used in the electrical connector.

2. Description of the Related Art

Early proposals regarding conventional electrical socket contacts are given, for instance, one is disclosed in Japanese Patent Application Laid-Open No. 2-52274. Such discloses an electrical socket contact which forms a conductor wire contact portion at one end and a short rectangularly tubular electrical contact portion provided with a resilient tongue for electric contact within the electric contact portion at the other end, wherein a concave portion for electric contact opposite to the resilient tongue is formed on a top-wall portion of the electrical contact portion, and a fastening wall extending from a side-wall portion is folded and overlapped on the top-wall portion, thereby fastening and securing the electrical contact portion.

However, the foregoing related art is constructed such that the electrical contact portion is undesirably over-sized and a connecter housing accommodating the electrical socket connect is also large-sized since the fastening wall is overlapped with the top wall portion.

SUMMARY OF THE INVENTION

It is the main object of this invention to provide an electrical socket contact wherein an electrical contact portion is formed in a compact size to which a mating contact is inserted and connected.

Another object of the invention is to provide an electrical socket contact which avoids enlarging the electrical contact portion assembled and secured in a short rectangularly tubular shape.

To achieve the above and other objects, according to one aspect of the present invention, there is provided an electrical socket contact constructed such that a concave portion opposite to a resilient tongue is formed in the transverse direction of a side end of a short rectangularly tubular electrical contact portion provided with the resilient tongue for electric contact within the electrical contact portion, and a folded portion extending from a side free end of the electrical contact portion engages the concave portion.

The folded portion of the side free end engages the concave portion, thereby fastening and securing the electrical contact portion. Moreover, the folded portion is placed within the concave portion and does not protrude outside, thus the electrical contact portion being compact.

Further objects and advantages of the present invention will appear more fully from the following description of the preferred embodiment with reference to the attached drawings.

DESCRIPTION OF THE PREFERRED EMBODIMENT

Figure 1:
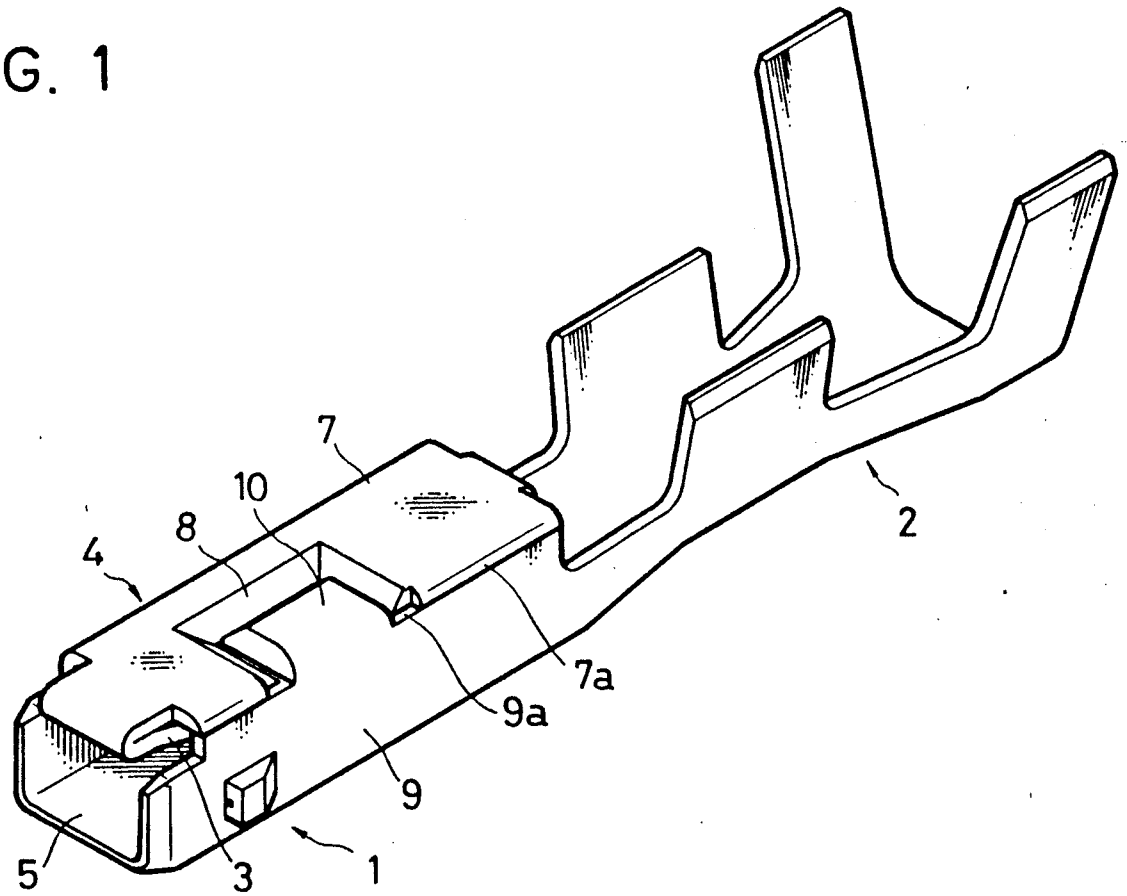
FIG. 1 is a perspective view showing one embodiment of an electrical socket contact according to the present invention.
Figure 2:
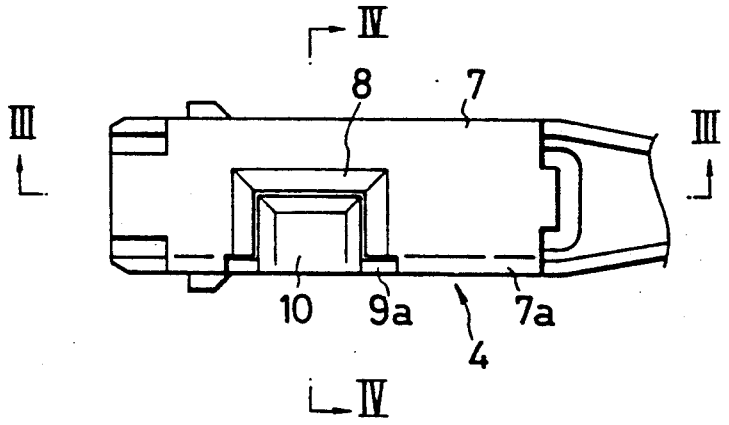
FIG. 2 is a top plan view of the same electrical socket contact.
Figure 3:
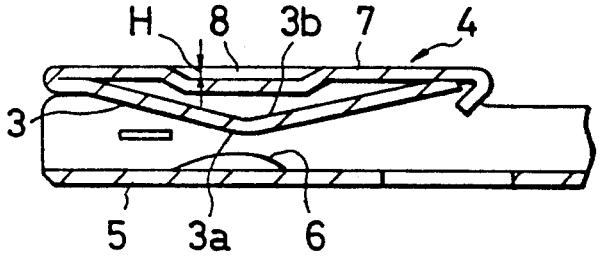
FIG. 3 sectional view taken on line III—III of FIG. 2.
Figure 4:
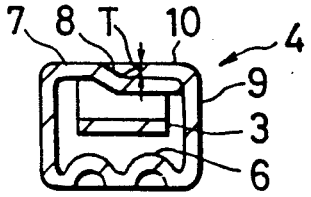
FIG. 4 is a sectional view taken on line IV—IV of FIG. 2.

A preferred embodiment will now be described in detail with reference to the drawings. Referring to FIG. 1, an electrical socket contact generally denoted by 1 forms a conductor wire contact portion 2 at one end and a short rectangularly tubular electrical contact portion 4 provided with a resilient tongue 3 for electrical contact within the electrical contact portion 4 at the other end to which a mating contact is inserted and connected. As shown in FIGS. 2–4, the electrical contact portion integrally includes a top-wall portion 7, a side-wall portion 9 and a bottom-wall portion 5 formed of electrically conductive materials, and connects a side-end portion 7*a* of the top-wall portion 7 to a free end 9*a* of the side-wall portion 9, thus forming a rectangularly tubular shape. The resilient tongue 3 is integrally included in the top wall portion 7 of the electrical contact portion, and arcuately extends inside of the electrical contact portion 4. The bottom-wall portion 5 forms a protruding portion for electrical contact 6 facing opposite to an arcuate apex portion 3*a* of the resilient tongue 3. The top-wall portion 7 forms a concave portion 8 at the place opposite to the reverse side 3*b* of the arcuate apex portion 3*a* of the resilient tongue 3, in the transverse direction of the side-end portion 7*a* of the top-wall portion 7. The side-end portion 7*a* is secured at the free end 9*a* of the side-wall portion 9. From the side-wall portion 9 extends a folded portion 10 which is folded in the transverse direction of the free end 9*a* at the place corresponding to the concave portion 8 of the top wall portion 7. The folded portion 10 engages the concave portion 8.

The concave portion 8 which prevents the excessive displacement of the resilient tongue 3 and the resulting distortion has the depth H as the same as or not less than the wall thickness T of the folded portion 10 so as to accommodate the folded portion 10 within the concave portion 8 and not to let the folded portion protrude from the surface of the top-wall portion 7.

Thus, the electrical contact portion 4 can be formed in a compact size. The folded portion 10 engaging within the concave portion 8 connects the top-wall portion 7 to the side-wall portion 9 securely against the displacement, thereby exerting a fastening and securing function. The concave portion 8 may not be limited for preventing the distortion, but may be for electrical contact as shown in one example of the related art.

According to the foregoing embodiment, the present invention offers the following advantages.

Since the folded portion engages within the concave portion of the electrical contact portion, the electrical contact portion is formed in a compact size, and a connector housing itself which accommodates the electrical socket contact may also be small-sized. Furthermore, the electrical contact portion is fastened and fixed more securely than conventionally by fitting the folded portion into the concave portion, thus improving its anti-deformation performance.

What is claimed is:

1. An electrical socket contact comprising:

a short rectangularly tubular electrical contact portion including a top-wall portion having a side-end portion, and a side-wall portion having a free-end portion abutting said side-end portion of said top-wall portion;

a resilient tongue for electrical contact provided within said electrical contact portion;

a concave portion formed opposite to said resilient tongue in the transverse direction of said side-end portion of said top-wall portion; and a folded portion extending from said free-end portion of said side-wall portion of said electrical contact portion, and engaging said concave portion.

2. An electrical socket contact comprising:

a short rectangularly tubular electrical contact portion formed of electrically conductive materials, including a top-wall portion having a side-end portion, a bottom-wall portion and two side-wall portions, wherein one of said two side-wall portions has a free-end portion abutting said side-end portion of said top-wall portion;

a resilient tongue for electrical contact provided within said electrical contact portion;

a concave portion formed opposite to said resilient tongue in the transverse direction of said side-end portion of said top-wall portion; and a folded portion, corresponding to said concave portion, extending in the transverse direction of said free-end portion of said side-wall portion of said electrical contact portion and engaging said concave portion.

3. An electrical socket contact as claimed in claim 2, wherein said resilient tongue is formed integrally with said top-wall portion of said electrical contact portion, and extends from the front end to the rear end within said electrical contact portion in an arched shape having an apex portion at the center thereof.

4. An electrical socket contact as claimed in claim 2, wherein said concave portion has a depth which is the same as or not less than the wall thickness of said folded portion.

5. An electrical socket contact as claimed in claim 3, wherein a protruding portion for electrical contact is provided at said bottom wall portion of said electrical contact portion, facing opposite to the reverse side of said apex portion of said arched shape of said resilient tongue.

* * * * *